US005834645A

United States Patent [19]

Bartels et al.

[11] Patent Number: 5,834,645

[45] Date of Patent: Nov. 10, 1998

[54] METHODS AND APPARATUS FOR THE IN-PROCESS DETECTION OF WORKPIECES WITH A PHYSICAL CONTACT PROBE

[75] Inventors: Anthony Bartels, Phoenix; Bob Allen, Gilbert; Chris Karlsrud, Chandler; Joe Mosca, Phoenix, all of Ariz.

[73] Assignee: Speedfam Corporation, Chandler, Ariz.

[21] Appl. No.: 889,999

[22] Filed: Jul. 10, 1997

[51] Int. Cl.[6] ..... G01B 5/28

[52] U.S. Cl. ..... 73/105; 73/865.8

[58] Field of Search ..... 73/104, 105, 865.8

[56] References Cited

U.S. PATENT DOCUMENTS

| | | | |
|---|---|---|---|
| 5,184,503 | 2/1993 | Hancock | 73/105 X |
| 5,531,632 | 7/1996 | Mizutani | 73/105 X |

FOREIGN PATENT DOCUMENTS

| | | | |
|---|---|---|---|
| 2083229 | 3/1982 | United Kingdom | 73/105 |

OTHER PUBLICATIONS

Excerpt from *OMRON Manual–Contact Linear Displacement Sensor D5M,* pp. 88–94.

*Primary Examiner*—Daniel S. Larkin
*Attorney, Agent, or Firm*—Snell & Wilmer

[57] ABSTRACT

An apparatus for detecting the presence of extraneous material on a polishing pad during a chemical mechanical planarization (CMP) process uses a contact probe assembly. The contact probe assembly interrogates the surface of the polishing pad during processing of a workpiece and generates a control signal indicating the presence of extraneous material when the displacement of a contact stylus exceeds a threshold amount. The contact probe assembly produces a control signal in response to the detection of extraneous material and the control signal causes the CMP system to react in an appropriate manner to reduce damage to the workpieces being processed.

23 Claims, 7 Drawing Sheets

METHODS AND APPARATUS FOR THE IN-PROCESS DETECTION OF WORKPIECES WITH A PHYSICAL CONTACT PROBE

TECHNICAL FIELD

The present invention relates, generally, to methods and apparatus for detecting the presence of extraneous objects on a processing element during a chemical mechanical planarization (CMP) process, and more particularly to an improved technique for detecting the in-situ, in-process loss or breakage of a semiconductor wafer using a probe that responds to physical contact with the wafer.

BACKGROUND ART AND TECHNICAL PROBLEMS

The production of integrated circuits begins with the creation of high-quality semiconductor wafers. During the wafer fabrication process, the wafers may undergo multiple masking, etching, and dielectric and conductor deposition processes. Because of the high-precision required in the production of these integrated circuits, an extremely flat surface is generally needed on at least one side of the semiconductor wafer to ensure proper accuracy and performance of the microelectronic structures being created on the wafer surface. As the size of integrated circuits continues to decrease and the number of microstructures per integrated circuit increases, the need for precise wafer surfaces becomes more important. Therefore, between each processing step, it is usually necessary to polish or planarize the surface of the wafer to obtain the flattest surface possible.

Chemical mechanical planarization (CMP) processes and apparatus are well known to those skilled in the art, and need not be discussed in detail herein. Such processes generally involve attaching one side of the wafer to a flat surface of a wafer carrier or chuck and pressing the other side of the wafer against a flat polishing surface. In general, the polishing surface includes a polishing pad that has an exposed abrasive surface of, for example, cerium oxide, aluminum oxide, fumed/precipitated silica, or other particulate abrasives. Commercially available polishing pads can be formed of various materials known in the art. Typically, a polishing pad may be formed from a blown polyurethane, such as the IC and GS series of polishing pads available from Rodel Products Corporation in Scottsdale, Ariz. The hardness, density, color, reflectivity, and other characteristics of the polishing pad may vary from application to application, e.g., according to the material that is to be polished.

During the polishing or planarization process, the workpiece or wafer is typically pressed against the polishing pad surface while the pad rotates about its vertical axis. In addition, to improve the polishing effectiveness, the wafer may also be rotated about its vertical axis and oscillated radially back and forth over the surface of the polishing pad. During the CMP process, workpieces occasionally become dislodged from the workpiece carrier, or they may break during polishing. If a dislodged workpiece, a part of a broken workpiece, or other extraneous material is allowed to remain on the polishing table, it could contact other workpieces and/or workpiece carriers on the same polishing table and thereby damage or destroy all of the workpieces on the table. Accordingly, it is desirable to detect the presence of a broken or dislodged workpiece immediately and to terminate processing until the situation can be rectified. Typically, this requires a thorough cleaning and/or replacement of the polishing pad, so that workpiece fragments and other debris can be removed so that they do not damage other intact workpieces.

Systems for detecting the loss of workpieces or for detecting broken workpieces are currently known. For example, U.S. patent application Ser. No. 08/683,150, filed Jul. 18, 1996, and U.S. patent application Ser. No. 08/781,132, filed Jan. 9, 1997, both assigned to SpeedFam Corporation of Chandler, Ariz., disclose two such systems. These patent applications are incorporated herein by reference. However, the presently known systems for detecting the loss of workpieces or for detecting broken workpieces may be unsatisfactory in several regards. For example, currently known systems that employ reflective optical signal processing may be limited to operation with a small number of similarly colored polishing pads. Such known systems may be ineffective for detecting wafer loss on a dark colored polishing pad or in an environment where the polishing pad may become discolored over time. Present systems may also be inadequate in CMP environments that employ a large amount of polishing slurry and/or polishing slurry having a variety of colors. Furthermore, the presence of slurry, deionized water, iodine (or other CMP compounds) on the pad and on the wafer itself tend to mask the reflected light signal, preventing the signal from being properly detected by the photodetector. Consequently, many presently known workpiece detection schemes often emit "false" readings whereupon machines are shut down and processing halted even though all disks remain intact within their respective carriers.

Therefore, a reliable and robust technique and apparatus for detecting lost or dislodged workpieces on a CMP polishing pad is thus needed which overcomes the shortcomings of the prior art.

SUMMARY OF THE INVENTION

In accordance with the present invention, methods and apparatus are provided which overcome many of the shortcomings of the prior art.

In accordance with a preferred embodiment, a contact stylus is suitably mounted proximate the upper surface of a CMP polishing table, such that the contact stylus physically responds to the presence of a fragment of a wafer or a lost wafer upon the table.

In accordance with a further aspect of the present invention, a processor produces an output indicative of the presence of extraneous material on the polishing pad in response to displacement of the contact stylus.

In accordance with yet a further aspect of the present invention, if a dislodged or fragmented wafer is detected on the polishing pad, the processor will send a signal to a CMP machine controller, immediately stopping processing of the CMP machine, or at least those processes which could be adversely affected by the lost or fragmented workpiece.

The above and other advantages of the present invention may be carried out by an apparatus for detecting the presence of extraneous material on a polishing pad during a planarization procedure. The apparatus includes a contact probe assembly for interrogating the surface of the polishing pad during the planarization procedure, where the contact probe assembly is capable of movement relative to the polishing pad. The apparatus also includes a detector for detecting displacement of the contact probe assembly when extraneous material physically contacts the contact probe assembly.

BRIEF DESCRIPTION OF THE DRAWING FIGURES

DETAILED DESCRIPTION OF A PREFERRED EXEMPLARY EMBODIMENT

The subject invention relates to the in-process detection of a dislodged or fractured workpiece on a polishing pad using a probe that is responsive to physical contact with the dislodged or fractured workpiece. The preferred embodiment set forth herein relates to the detection of semiconductor wafers on a chemical mechanical planarization (CMP) polishing pad; it will be appreciated, however, that the principles of the present invention may be employed to detect workpieces or other materials in a variety of processing (e.g., polishing or planarization) environments such as, for example, hard disks and the like.

Figure 1:
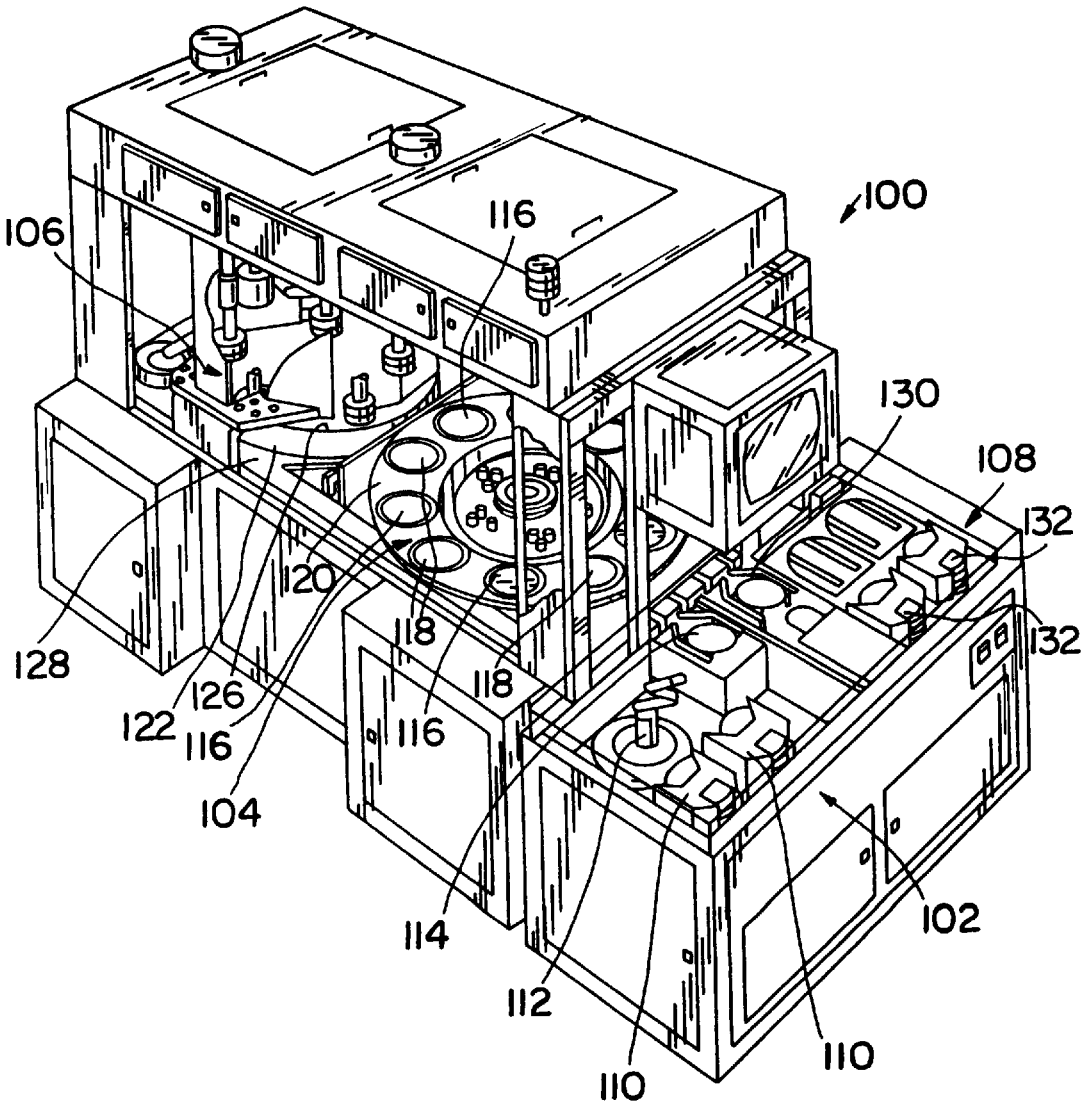
FIG. 1 is a perspective view of an exemplary CMP machine useful in the context of the present invention.
Figure 2:
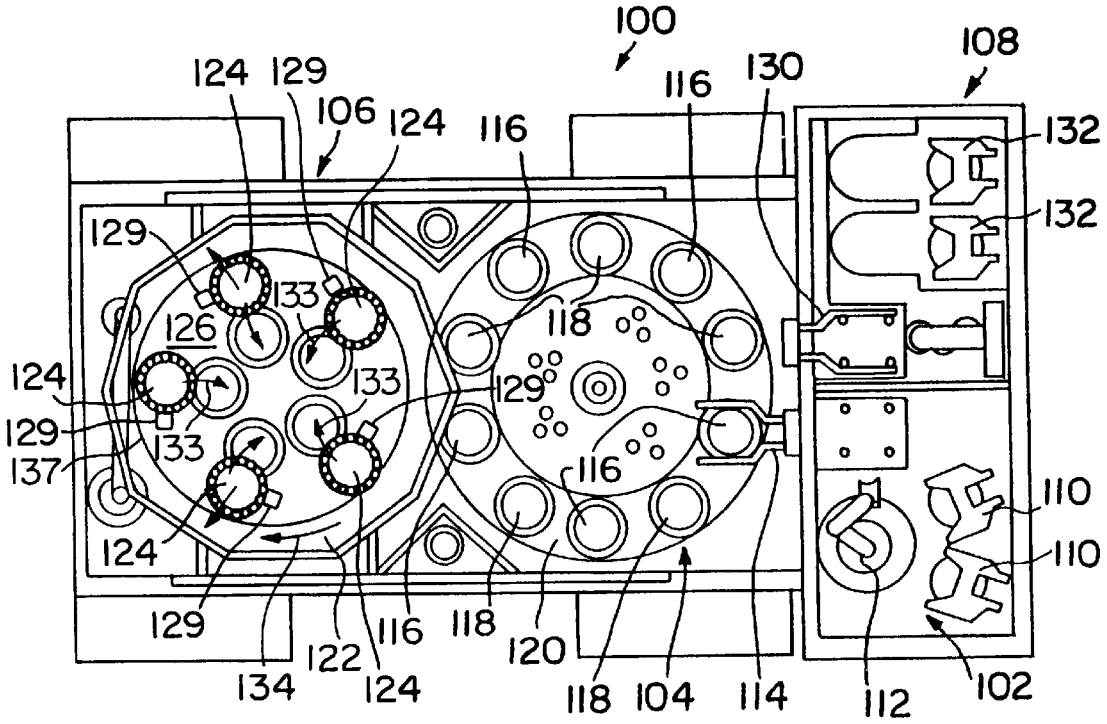
FIG. 2 is a top view of the CMP machine of FIG. 1, showing an exemplary orientation of a contact probe assembly in accordance with the present invention.

Referring now to FIGS. 1 and 2, a wafer polishing apparatus 100 in the form of a CMP system is shown embodying the present invention. Wafer polishing apparatus 100 is suitably configured to accept wafers from a previous processing step, polish and rinse the wafers, and reload the wafers into wafer cassettes for subsequent processing.

Discussing now the polishing apparatus 100 in more detail, apparatus 100 includes an unload station 102, a wafer transition station 104, a polishing station 106, and a wafer rinse and load station 108.

In accordance with a preferred embodiment of the present invention, one or more of cassettes 110, each holding a plurality of wafers, are placed into the machine at unload station 102. Next, a robotic wafer carrier arm 112 removes the wafers from cassettes 110 and places them, one at a time, on a first wafer transfer arm 114. Wafer transfer arm 114 then individually lifts and moves each wafer into wafer transition section 104. That is, transfer arm 114 suitably sequentially places an individual wafer on each one of a plurality of wafer pick-up stations 116 which reside on a rotatable table 120 within wafer transition section 104. Rotatable table 120 also suitably includes a plurality of wafer drop-off stations 118 which alternate with pick-up stations 116. After a wafer is deposited on one of the plurality of pick-up stations 116, table 120 will rotate so that a new station 116 aligns with transfer arm 114. Transfer arm 114 then places the next wafer on the new empty pick-up station 116. This process continues until all pick-up stations 116 are filled with wafers. In the preferred embodiment of the invention, table 120 includes five pick-up stations 116 and five drop-off stations 118.

Next, a wafer carrier apparatus 122, having individual wafer carrier elements 124, suitably aligns itself over table 120 so that respective carrier elements 124 are positioned directly above the wafers which reside in respective pick-up stations 116. The carrier apparatus 122 then drops down and picks up the wafers from their respective stations and moves the wafers laterally such that the wafers are positioned above polishing station 106. Once above polishing station 106, carrier apparatus 122 suitably lowers the wafers, which are held by individual elements 124, into operative engagement with a polishing pad 126 disposed upon a lap wheel 128. During operation, lap wheel 128 causes polishing pad 126 to rotate about its vertical axis, for example, in a counter-clockwise direction as shown by arrow 134. At the same time, individual carrier elements 124 spin the wafers about their respective vertical axes and oscillate the wafers radially back and forth across pad 126 (substantially along arrows 133) as they press against the polishing pad. In this manner, the surface of the wafer will be polished or planarized.

After an appropriate period of processing time, the wafers are removed from polishing pad 126, and carrier apparatus 122 transports the wafers back to transition station 104. Carrier apparatus 122 then lowers individual carrier elements 124 and deposits the wafers onto drop-off stations 118. The wafers are then removed from drop-off stations 118 by a second transfer arm 130. Transfer arm 130 suitably lifts each wafer out of transition station 104 and transfers them into wafer rinse and load station 108. In the load station 108, transfer arm 130 suitably holds each wafer while it is being rinsed. After a thorough rinsing, the wafers are reloaded into cassettes 132, which then transports the wafer to subsequent stations for further processing or packaging.

Although CMP machine 100 is shown having five polishing stations, it will be appreciated that the present invention may be employed in the context of virtually any number of polishing stations. Moreover, the present invention may also be employed in circumstances where not all of the polishing stations are functioning at the same time. For example, many standard wafer cassettes carry twenty-four individual workpieces in a single cassette. Consequently, because there are often five workpiece chucks on a single CMP machine, the last four disks within a cassette may be polished at one time, leaving the fifth disk-holder empty.

With continued reference to FIG. 2, a respective contact probe assembly 129 is suitably configured on wafer carrier apparatus 122 near each carrier element 124. In accordance with a particularly preferred embodiment of the invention, each contact probe assembly 129 is suitably configured to interrogate at least a portion of the polishing pad surface proximate each carrier element 124 to detect the presence of extraneous material, such as a loose screw, a wafer, or a wafer fragment on the surface of polishing pad 126 as described in greater detail below. In the context of this description, polishing pad 126 is one example of a processing element with which the present invention may be configured to interact.

Figure 3:
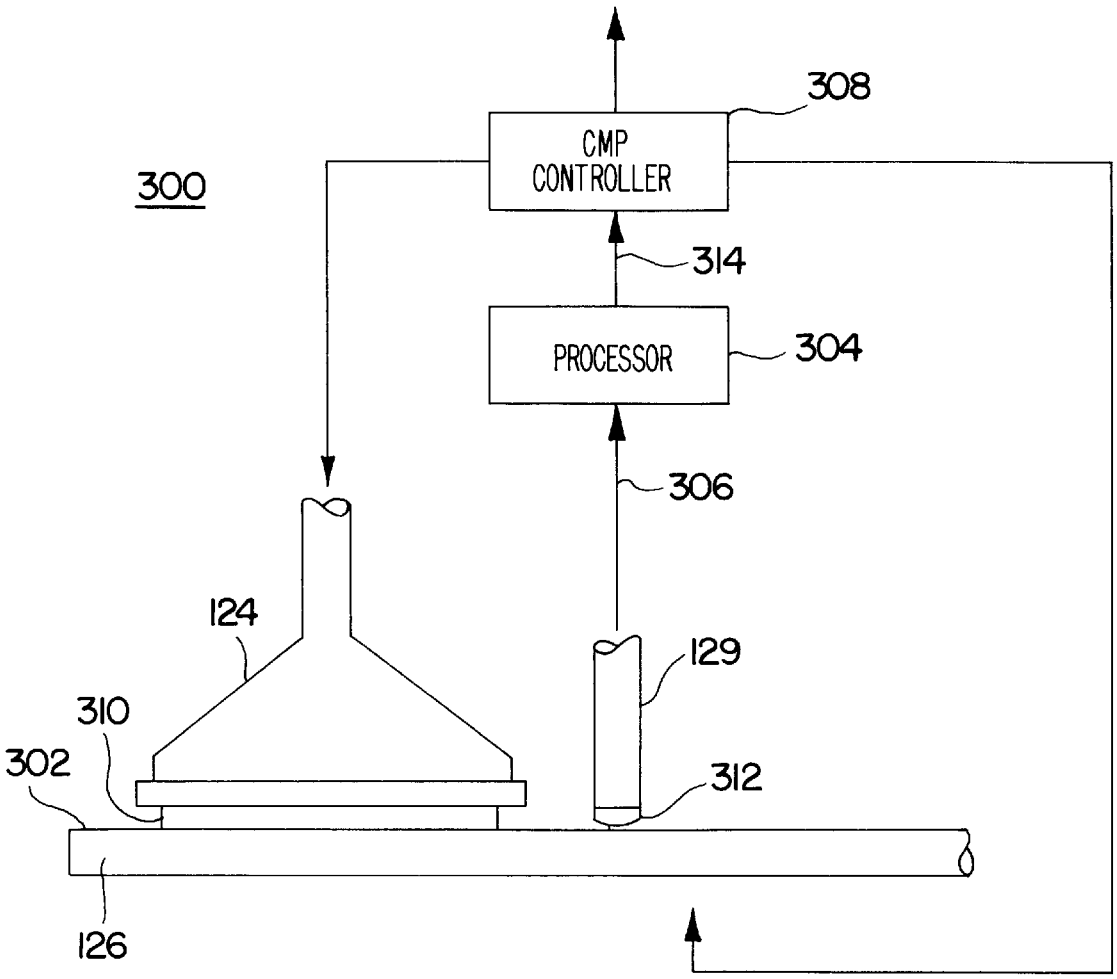
FIG. 3 is a schematic depiction of an exemplary contact probe and an associated workpiece detection system.

Referring now to FIG. 3, a schematic representation of an exemplary contact probe assembly 129 in accordance with the present invention is illustrated in conjunction with a workpiece detection system 300. Although apparatus 100 preferably includes a plurality of probe assemblies 129 for use with a number of carrier elements 124, only a single probe assembly 129 is illustrated in FIG. 3 for clarity. Detection system 300 preferably includes at least one probe assembly 129 for interrogating the upper surface 302 of polishing pad 126, a processor 304 for receiving and processing a control signal 306 generated by probe assembly 129, and a CMP controller 308 configured to control various components associated with polishing apparatus 100, e.g., carrier element 124 and lap wheel 128 with polishing pad 126. It should be appreciated that control signal 306 may be associated with any number of measurable electrical characteristics such as current or voltage and that control signal 306 may be a digital representation or an analog signal.

As best seen in FIG. 3, an exemplary workpiece 310 is shown being held by carrier element 124 and polished by polishing pad 126 as described above in conjunction with FIGS. 1 and 2. For clarity, the other components of apparatus 100 are omitted from FIG. 3. Contact probe assembly 129 is suitably mounted proximate to and above polishing pad 126 such that, when in operation, a contact stylus 312 contacts (or nearly contacts) upper surface 302 of polishing pad 126. In this manner, and as described in more detail below, contact probe assembly 129 preferably monitors polishing pad 126 for the presence of extraneous material during polishing of workpiece 310. In the preferred embodiment, contact probe assembly 129 interrogates upper surface 302 in a substantially continuous manner during processing of workpiece 310.

In an exemplary embodiment, contact probe assembly 129 may be mounted under the multi-head transport assembly (MHTA) which is part of carrier apparatus 122 in a position that will suitably allow contact probe assembly 129 to interrogate polishing pad 126 at an appropriate location. In accordance with the preferred embodiment, contact probe assembly 129 is mounted in a substantially stationary position relative to polishing pad 126, and carrier element 124 is capable of rotational and translational movement relative to contact probe assembly 129.

In accordance with the illustrated embodiment, at least one contact probe assembly 129 is suitably mounted proximate each carrier element 124 such that the associated contact stylus 312 is located directly in front of the respective carrier element 124. That is, if polishing pad 126 is rotating counter-clockwise, as shown by arrow 134 (see FIG. 2), contact stylus 312 is positioned such that a wafer (or wafer fragment) will touch contact stylus 312 immediately upon becoming dislodged from carrier element 124. In this manner, contact probe assembly 129 will detect a dislodged wafer or wafer fragment as soon as possible to enable workpiece detection system 300 to take the appropriate action, e.g., disable polishing apparatus 100 before other wafers can be damaged by the broken/dislodged workpiece or other debris. Of course, if polishing pad 126 is rotating clockwise, then the associated contact stylus 312 should be positioned at the opposite side of each carrier element 124.

It should be appreciated that contact probe assembly 129 may be angularly oriented relative to upper surface 302 rather than substantially perpendicular as shown in FIG. 3. Such an angular orientation may be desirable to enhance the detection sensitivity of contact probe assembly 129 or to facilitate fine tuning for the specific application.

In accordance with a particularly preferred embodiment of the present invention, and with continued reference to FIG. 3, contact probe assembly 129 suitably generates control signal 306 in response to vertical displacement of contact stylus 312, relative to polishing pad 126, by at least a threshold amount. The predetermined threshold distance may be selected according to the specific application, the CMP environment, or the extraneous material intended to be detected. For example, a preferred embodiment configured to detect a semiconductor wafer may utilize a threshold amount within the range of 5 to 20 mils. This threshold amount is selected to ensure that workpiece detection system 300 reliably detects physical contact between a lost or fragmented wafer and contact stylus 312.

Figure 8:
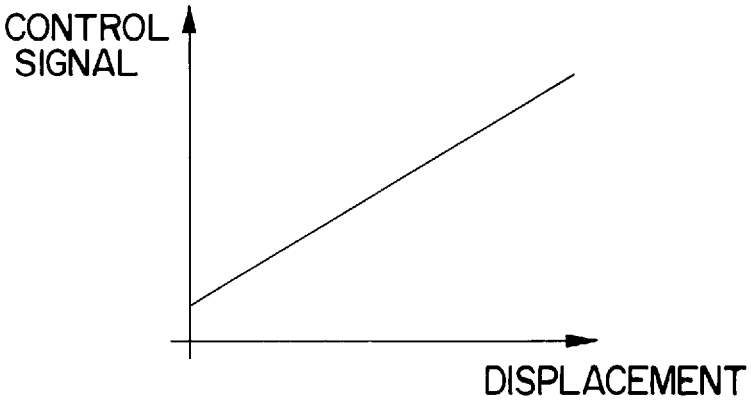
FIG. 8 is a graph of an exemplary response characteristic associated with a displacement detector that may be utilized by the contact probe assembly.

Control signal 306 may be an analog signal having a linear characteristic relative to the amount of displacement of contact stylus 312 (see FIG. 8). In the preferred embodiment, control signal 306 is characterized by a substantially linear current-to-displacement output function. Although not described in detail herein, workpiece detection system 300 may employ any number of conventional signal conditioning techniques, known to those skilled in the art, to suitably process control signal 306 before and/or after it is received by processor 304. It should be appreciated that contact probe assembly 129 may be additionally configured to produce a bias signal associated with the initial position of contact stylus 312, relative to upper surface 302 of polishing pad 126; control signal 306 may be associated with a linear increase (or decrease) in the bias signal that is suitably detected and processed by processor 304. As mentioned above, nothing limits the present invention to the use of analog control signals and control signal 306 may be alternately configured as a digital signal or a digital word associated with the displacement of contact stylus 312.

Processor 304 is preferably configured to process control signal 306 and to produce an output signal 314 indicative of the presence of extraneous material proximate contact stylus 312. Processor 304 is preferably configured to indicate the presence of extraneous material on upper surface 302 when control signal 306 exceeds a predetermined threshold value. Consequently, workpiece detection system 300 refrains from indicating the presence of extraneous material on upper surface 302 when control signal 306 is less than the threshold value. The particular threshold value for control signal 306 (which is associated with the threshold displacement of contact stylus 312) may be selected according to the operating specifications of contact probe assembly 129 or other components of apparatus 100. It should be appreciated that, rather than employ a single threshold control signal value, workpiece detection system 300 may be alternately configured to indicate the presence of a wafer on polishing pad 126 when control signal 306 falls within a predetermined voltage or current range. Such a configuration may be desirable to reduce false detections or to otherwise increase the reliability or robustness of workpiece detection system 300.

According to a desired aspect of the present invention, if a wafer or wafer fragment is detected, processor 304 sends output signal 314 to CMP controller 308 which, in turn, immediately shuts down the machine. In a particularly preferred embodiment of the invention, CMP controller 308 may include a separate control device connected to the main processor/controller of polishing apparatus 100, or CMP controller 308 may be configured as part of the main unit. Further, CMP controller 308 may be configured as part of processor 304. As will be appreciated by one skilled in the art, CMP controller 308 may employ any type and configuration of controller capable of shutting down polishing apparatus 100. Output signal 314 may alternatively, or additionally, trigger warning devices or control various other components of apparatus 100. Rather than disabling the machine, CMP controller 308 may produce an output indicative of the presence of extraneous material upon polishing pad 126 or suitably adjust an appropriate operating parameter of the system to reduce or eliminate the likelihood of damage.

Figure 4:
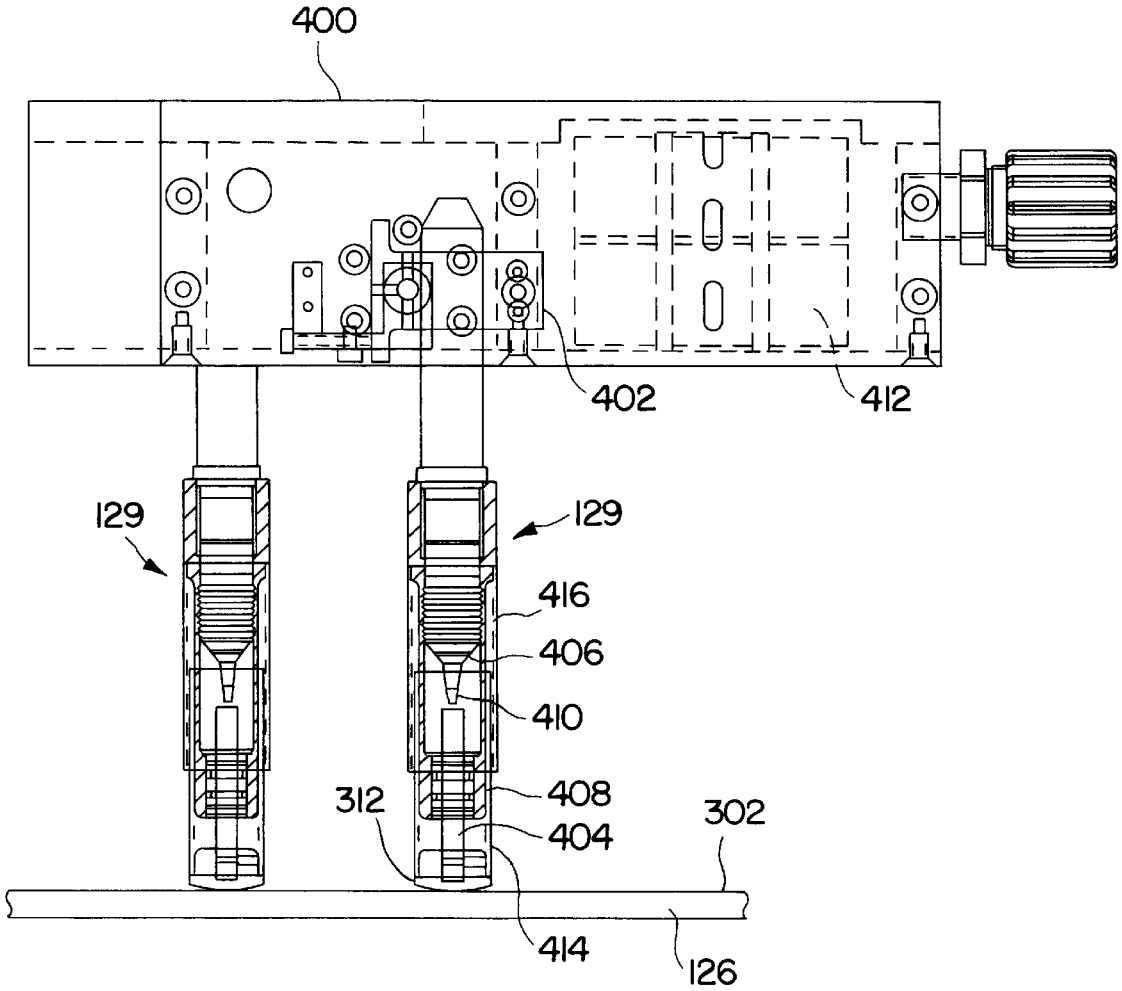
FIG. 4 is a phantom side view of a probe actuator housing with a contact probe assembly in a lowered position.
Figure 5:
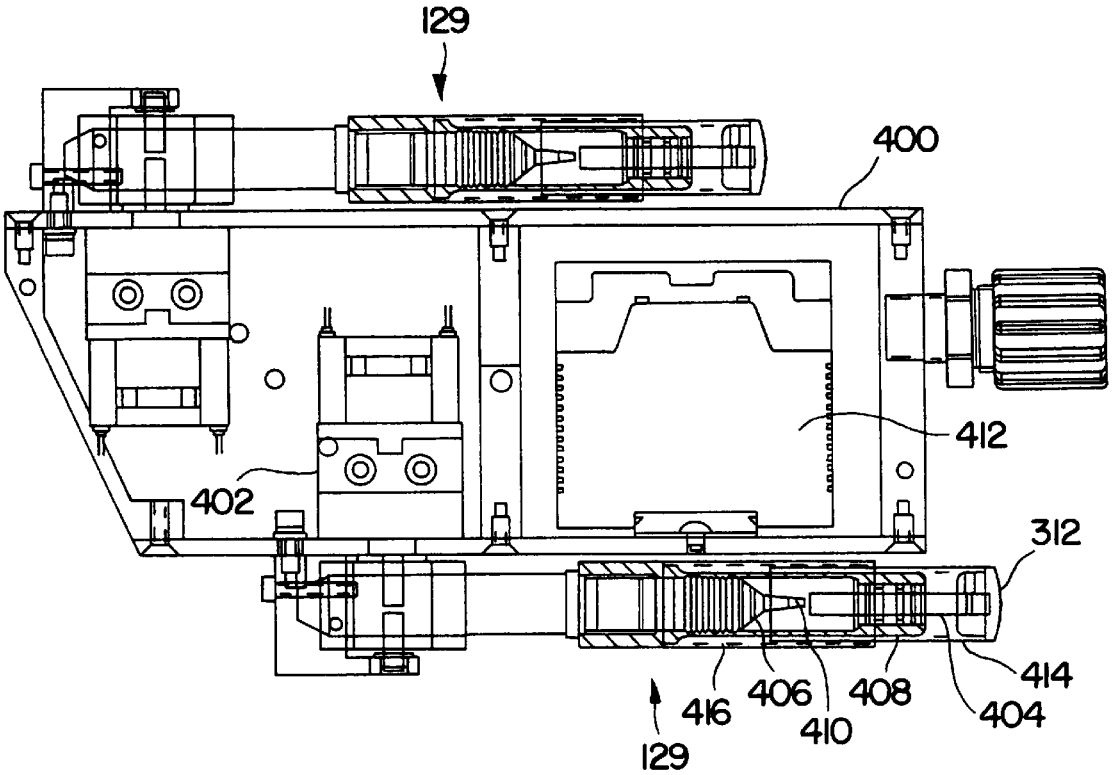
FIG. 5 is a phantom top view of the probe actuator housing shown in FIG. 4 with the contact probe assembly in a raised position.
Figure 6:
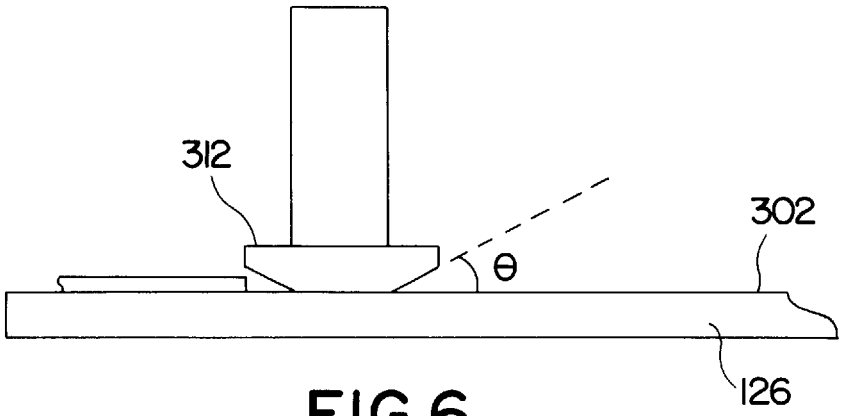
FIG. 6 is a schematic representation of a contact stylus employed by the contact probe assembly in a bias position.
Figure 7:
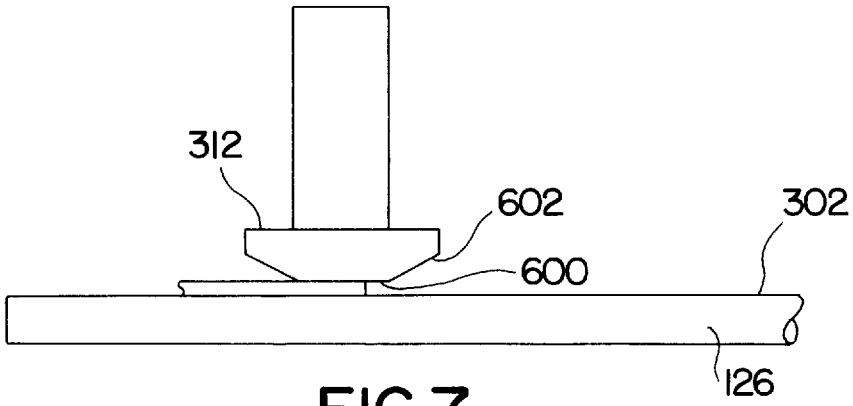
FIG. 7 is a schematic representation of the contact stylus in a displaced position.

The operation and configuration of contact probe assembly 129 will now be described in conjunction with FIGS. 4–7. FIGS. 4 and 5 are phantom views of a probe actuator housing 400 and associated contact probe assemblies 129; FIGS. 6 and 7 are schematic representations of contact stylus 312 in typical operating conditions.

As described above, actuator housing 400 may be suitably mounted to polishing apparatus 100 in a position that enables contact probe assemblies 129 to effectively interrogate upper surface 302 of polishing pad 126 proximate wafer carriers 124 (see FIG. 2). In the exemplary embodiment shown in FIGS. 4 and 5, each actuator housing 400 has two contact probe assemblies 129 coupled thereto. The use of multiple contact probe assemblies 129 may be desirable to address space limitations of polishing apparatus 100 or to facilitate effective interrogation of differently sized polishing pads 126. Polishing apparatus 100 preferably employs at least one contact probe assembly 129 for each active wafer carrier 124, e.g., at least five in the exemplary embodiment shown in FIGS. 1 and 2. For purposes of this description, each contact probe assembly 129 is substantially similar in configuration and functionality. Consequently, only one contact probe assembly 129 will be described in detail below.

Contact probe assembly 129 may be pivotally coupled to actuator housing 400 such that it may be raised during inactive periods (see FIG. 5) and lowered to interrogate polishing pad 126 during processing of workpiece 310 (see FIG. 4). Contact probe assembly 129 may be raised to provide clearance for efficient operation of polishing apparatus 100. In the preferred embodiment, contact probe assembly 129 is coupled to actuator housing 400 via an air cylinder 402, which, when appropriately activated, causes contact probe assembly 129 to pivot upward or downward. Although not shown, air cylinder 402 may be in communication with and controlled by CMP controller 308 or any other control system employed by polishing apparatus 100. Those skilled in the art should appreciate that any suitable device may be alternately utilized to engage contact probe assembly 129, e.g., an electromagnetic solenoid or a mechanical gear arrangement.

In accordance with an exemplary embodiment of the present invention, contact probe assembly 129 generally includes contact stylus 312, a shaft 404, and a displacement detector 406. As described above, contact stylus 312 interrogates upper surface 302 of polishing pad 126 and deflects in response to physical contact with extraneous material present upon upper surface 302. Contact stylus 312 is coupled to one end of shaft 404, which is received within a sleeve bearing 408. Sleeve bearings and equivalent structures are well known in the art and any number of commercially available components may be utilized for sleeve bearing 408. Sleeve bearing 408 retains shaft 404 along a substantially constant axis and preferably limits movement of shaft 404 in a direction compatible with displacement detector 406 (described below). In the preferred embodiment, contact stylus 312 and shaft 404 are configured for translational movement in a substantially perpendicular direction relative to polishing pad 126 when contact probe assembly 129 is in the lowered position (see FIG. 4).

The end of shaft 404 opposing contact stylus 312 engages displacement detector 406 such that contact stylus 312 is physically coupled to displacement detector 406 via shaft 404. Displacement detector 406 may utilize any suitably configured actuator tip 410, e.g., a roller wheel or a ball bearing. Actuator tip 410 may be attached to shaft 404 or be configured to merely contact the end of shaft 404. When extraneous material causes contact stylus 312 to raise (see FIG. 7), shaft 404 engages displacement detector 406, which produces an intermediate control signal (not shown). The intermediate control signal serves as an input to an amplifier 412, which suitably amplifies and/or conditions the intermediate control signal to produce control signal 306 (see FIG. 3). Those skilled in the art will appreciate that amplifier 412 may be configured in accordance with known technologies and that the specific operating parameters of amplifier 412 may be selected for compatibility with the detection sensitivity of displacement detector 406, the output range of displacement detector 406, the operating conditions of polishing apparatus 100, and/or any number of application-specific variables.

In accordance with a preferred embodiment of the present invention, displacement detector 406 includes a linear displacement transducer. Although the present invention may utilize a displacement transformer, such transformers typically exhibit a relatively slow response time. To ensure that a broken or dislodged wafer is immediately detected, displacement detector 406 preferably has a response time within a range of 1 to 20 ms. This preferred range may vary depending upon the rotational speed of polishing pad 126, the location of contact stylus 312 relative to wafer carrier 124, and other operating parameters. One linear displacement transducer suitable for purposes of the present invention is commercially available from Omron (part number D5M). Such commercially available linear contact displacement sensors may include a matched amplifier that may be suitable for use as amplifier 412.

Contact probe assembly 129 may include a number of splash guards configured to prevent water, slurry, debris, and/or other processing materials from contaminating the components of contact probe assembly 129. In particular, a first splash guard 414 substantially surrounds shaft 404 and sleeve bearing 408. First splash guard 414 may cooperate with a second splash guard 416 to provide further protection for displacement detector 406. In the exemplary embodiment shown in FIGS. 4 and 5, first and second splash guards 414 and 416 are coupled together to form a telescoping arrangement. The telescoping arrangement enables first and second splash guards 414 and 416 to move in conjunction with the displacement of contact stylus 312. In the preferred embodiment, first and second splash guards 414 and 416 are formed of TEFLON or a TEFLON coated metal. Alternatively, any water resistant and corrosion resistant material may be utilized for first and second splash guards 414 and 416.

An alternate embodiment may employ a contamination rinse assembly instead of (or in addition to) first and second splash guards 414 and 416. Such a rinse assembly may dispense deionized water, or any other suitable rinse solution, to appropriately clean contact probe assembly 129. It should be appreciated that the rinse assembly may be suitably controlled to dispense the cleaning solution during processing of workpieces, between processing cycles, or at any other desired time.

With reference to FIGS. 6 and 7, contact stylus 312 will be described in more detail. Contact stylus 312 is preferably formed of TEFLON, DELRIN, or an equivalent corrosion resistant material having a relatively low coefficient of friction. The particular material selected for contact stylus 312 may vary depending upon the downward pressure imparted by contact probe assembly 129, the composition of polishing pad 126, and/or other application-specific parameters.

Contact stylus 312 has a substantially round perimeter, which enables consistent detection of material traveling in any direction relative to contact probe assembly 129. To facilitate effective displacement in response to physical contact with extraneous material, e.g., a wafer or a wafer fragment, the base of contact stylus 312 may be upwardly tapered from a central portion 600 to an outer portion 602 (see FIG. 7). Central portion 600 may be adapted to substantially reside upon upper surface 302 when contact stylus 312 is in the bias position shown in FIG. 6. Contact stylus 312 may upwardly taper at an angle θ (FIG. 6) within the range of 10 to 20 degrees, and preferably at approximately 15 degrees, relative to upper surface 302. Angle θ may be selected according to the anticipated thickness of the extraneous material such that contact stylus 312 readily deflects upward to allow the extraneous material to pass between upper surface 302 and central portion 600.

Figure 9:
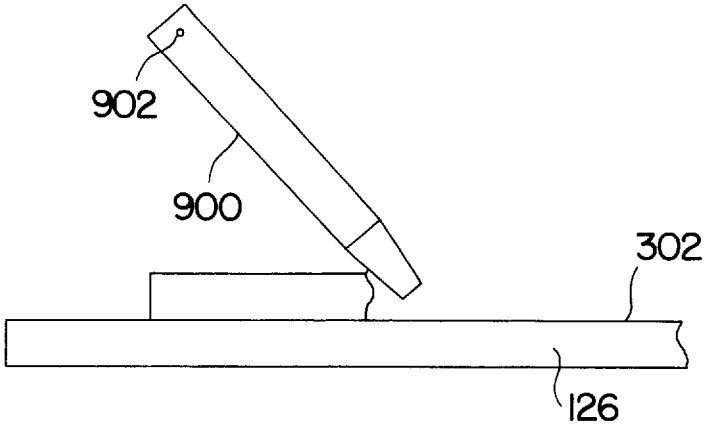
FIGS. 9–11 are schematic representations of alternate contact probes that may be employed by the present invention.

FIG. 9 is a schematic depiction of an alternate contact stylus 900 that may be employed by the present invention. Contact stylus 900 is preferably configured for angular movement about an axis of rotation 902 oriented substantially parallel to polishing pad 126. In other words, contact stylus 900 exhibits a pendulum motion in response to contact with a lost or dislodged wafer. The bias position of contact stylus 900 may be substantially perpendicular to upper surface 302, and any suitable detection device (not shown) may communicate with contact stylus 900 to monitor the rotation and/or the deflection of contact stylus 900 beyond the bias position. For example, displacement detector 406 (see FIGS. 4 and 5) may be suitably modified to measure deflection of contact stylus 900.

Figure 10:
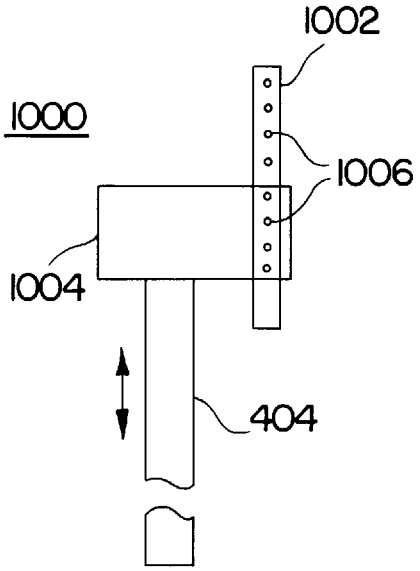

FIG. 10 is a schematic representation of an alternate displacement detector 1000 that may utilize fiber optic sensor techniques. Displacement detector 1000 preferably includes a plurality of optical fibers arranged in a fiber optic array 1002 and a trigger block 1004, which may be coupled to the end of shaft 404 (see FIGS. 4 and 5). Fiber optic array 1002 may be commercially available and configured in accordance with known methodologies such that each individual fiber emits a distinct detection beam 1006. Trigger block 1004, or any other suitable structure, is configured to interrupt at least one detection beam 1006 when the displacement of contact stylus 312 exceeds the threshold amount. In an alternate embodiment, displacement detector 1000 may employ a single optical fiber that functions as a binary switch.

Processor 304 (see FIG. 3) may communicate with fiber optic array 1002 to determine how many detection beams 1006 are currently interrupted and/or unobscured. As shown in FIG. 10, the number of interrupted detection beams 1006 is related to the displacement of contact stylus 312. If a predetermined number of detection beams 1006 are obscured by trigger block 1004, then processor 304 generates output signal 314 for CMP controller 308 (described above). The use of fiber optic array 1002 is desirable to enable displacement detector 1000 to establish a bias position associated with contact stylus 312. Thus, output signal 314 may be produced in response to the interruption of a differential number of detection beams 1006, relative to the number of detection beams 1006 that are interrupted in the bias position.

Figure 11:
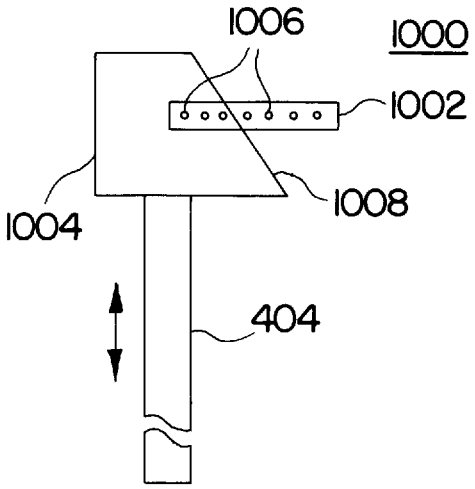

The sensitivity of displacement detector 1000 may be adjusted by appropriately configuring trigger block 1004. For example, and as shown in FIG. 11, trigger block 1004 may be formed with an angular face 1008 to adjust the number of detection beams 1006 that are interrupted by trigger block 1004 for a given displacement of contact stylus 312. Those skilled in the art should appreciate that it may be desirable to adjust the sensitivity of displacement detector 1000 to accommodate the operating parameters of associated conditioning circuits, amplifiers, processors, or other components of workpiece detection system 300. Furthermore, the specific manner in which the sensitivity of displacement detector 1000 is adjusted may vary from the embodiment shown in FIG. 11.

In summary, the present invention provides a technique for the in-process detection of extraneous material upon a polishing pad; the technique employs a contact stylus mounted proximate the upper surface of the polishing pad. The contact stylus physically responds to the presence of a fragment of a wafer or a lost wafer upon the table. A processor produces an output indicative of the presence of extraneous material on the polishing pad in response to displacement of the contact stylus. Preferably, if a dislodged or fragmented wafer is detected on the polishing pad, the processor will send a signal to a CMP controller, which immediately disables the CMP machine, or at least those processes which could be adversely affected by the lost or fragmented workpiece.

The present invention has been described above with reference to preferred embodiments. However, those skilled in the art will recognize that changes and modifications may be made to the preferred embodiment without departing from the scope of the present invention. For example, any suitable displacement sensor may be employed by the present invention in place of the linear displacement transducer described herein. In addition, the present invention is not limited to use with the specific polishing apparatus shown and described herein or to use with semiconductor wafers. These and other changes or modifications are intended to be included within the scope of the present invention, as expressed in the following claims.

What is claimed is:

1. In a chemical mechanical planarization (CMP) system having a polishing pad and a carrier element configured to hold a workpiece against said polishing pad, an apparatus for detecting the presence of extraneous material on said polishing pad during a planarization procedure, said apparatus comprising:

means for interrogating the surface of said polishing pad proximate said carrier element during said planarization procedure, said means for interrogating being capable of movement relative to said polishing pad; and means for detecting displacement of said means for interrogating when extraneous material physically contacts said means for interrogating.

2. An apparatus according to claim 1, wherein said means for interrogating physically contacts said polishing pad during said planarization procedure.

3. An apparatus according to claim 1, wherein said means for interrogating is physically coupled to said means for detecting.

4. An apparatus according to claim 1, wherein:

said means for detecting produces a control signal that is substantially proportional to the displacement of said means for interrogating; and said apparatus further comprises means for processing said control signal to produce an output indicative of the presence of extraneous material upon said polishing pad.

5. An apparatus according to claim 4, wherein said means for processing produces said output when the displacement of said means for interrogating exceeds a threshold amount.

6. An apparatus according to claim 5, wherein said threshold amount is within the range of 5 to 20 mils.

7. An apparatus according to claim 1, wherein said means for interrogating is configured for translational movement in a substantially perpendicular direction relative to said polishing pad.

8. An apparatus according to claim 1, wherein said means for interrogating is configured for angular movement about an axis of rotation oriented substantially parallel to said polishing pad.

9. An apparatus according to claim 1, wherein said means for detecting comprises:

a plurality of optical fibers for producing a plurality of detection beams;

means for interrupting at least one of said detection beams when the displacement of said means for interrogating exceeds a threshold amount, said means for interrupting being coupled to said means for interrogating; and a processor configured to produce an output indicative of the presence of extraneous material upon said polishing pad when at least a predetermined number of said detection beams are interrupted.

10. In a workpiece processing system having a processing element and a carrier element configured to hold a workpiece against said processing element, an apparatus for detecting the presence of extraneous material on said processing element during processing of said workpiece, said apparatus comprising:

a contact stylus configured to contact a surface of said processing element during processing of said workpiece;

means for detecting displacement of said contact stylus in response to physical contact between said contact stylus and extraneous material present upon said processing element; and a processor in communication with said means for detecting, said processor being configured to produce an output indicative of the presence of extraneous material upon said processing element when the displacement of said contact stylus exceeds a threshold amount.

11. An apparatus according to claim 10, wherein said means for detecting displacement is configured to produce a substantially linear control signal, relative to the displacement of said contact stylus.

12. An apparatus according to claim 11, wherein said means for detecting displacement comprises a linear displacement transducer.

13. An apparatus according to claim 10, wherein said means for detecting displacement has a response time within the range of 1 to 20 ms.

14. An apparatus according to claim 10, wherein said contact stylus upwardly tapers, relative to said processing element, from a central portion to an outer portion to facilitate upward displacement of said contact stylus in response to physical contact with extraneous material.

15. An apparatus according to claim 14, wherein said contact stylus upwardly tapers at an angle within the range of 10 to 20 degrees.

16. An apparatus according to claim 10, further comprising:

a shaft coupled to said contact stylus and configured to engage said means for detecting; and a sleeve bearing for retaining said shaft and for limiting movement of said shaft in a direction compatible with said means for detecting.

17. An apparatus according to claim 16, further comprising a splash guard substantially surrounding at least one of said shaft, said sleeve bearing, and said means for detecting.

18. In a workpiece processing system having a processing element and a carrier element configured to hold a workpiece against said processing element, a method for detecting the presence of extraneous material on said processing element during operation of said workpiece processing system, said method comprising the steps of:

maintaining a contact stylus proximate a surface of said processing element during processing of said workpiece;

monitoring for displacement of said contact stylus relative to said surface; and indicating the presence of extraneous material proximate said contact stylus when the displacement of said contact stylus exceeds a threshold amount.

19. A method according to claim 18, wherein said indicating step indicates when said workpiece is dislodged from said carrier element and wherein said extraneous material comprises said workpiece.

20. A method according to claim 18, further comprising the step of adjusting an operating parameter of said workpiece processing system in response to said indicating step.

21. A method according to claim 18, wherein said predetermined distance is within the range of 5 to 20 mils.

22. A method according to claim 18, wherein said monitoring step comprises the steps of:

generating a bias signal associated with an initial position of said contact stylus relative to said processing element; and generating a detection signal associated with a displaced position of said contact stylus relative to said processing element, said generating step being performed in accordance with a substantially predetermined output function.

23. A method according to claim 22, wherein said output function is substantially linear.

* * * * *